United States Patent [19]

Morrell et al.

[11] Patent Number: 5,013,093

[45] Date of Patent: May 7, 1991

[54] UNIVERSAL RIPPER MINER

[75] Inventors: Roger J. Morrell, Bloomington; David A. Larson, Minneapolis, both of Minn.

[73] Assignee: The United States of America as represented by the Secretary of the Interior, Washington, D.C.

[21] Appl. No.: 351,134

[22] Filed: May 4, 1989

[51] Int. Cl.[5] ..... E21C 29/30

[52] U.S. Cl. ..... 299/67; 299/85; 299/88; 299/91

[58] Field of Search ..... 299/67, 79, 89, 88, 299/91, 93, 85; 175/410, 412, 413; 37/142 R

[56] References Cited

U.S. PATENT DOCUMENTS

| | | | |
|---|---|---|---|
| 2,745,655 | 5/1956 | Vojtush | 299/88 |
| 3,088,720 | 5/1963 | Hlinsky | 175/413 X |
| 4,342,486 | 8/1982 | O'Neill | 299/88 X |
| 4,501,448 | 2/1985 | Morrell et al. | 299/67 |

FOREIGN PATENT DOCUMENTS

| | | | |
|---|---|---|---|
| 3308370 | 9/1984 | Fed. Rep. of Germany | 299/79 |
| 609883 | 6/1978 | U.S.S.R. | 299/79 |
| 16476 | of 1891 | United Kingdom | 299/91 |
| 1284539 | 8/1972 | United Kingdom | 299/91 |
| 2053315 | 2/1981 | United Kingdom | 299/91 |

*Primary Examiner*—Ramon S. Britts
*Assistant Examiner*—David J. Bagnell
*Attorney, Agent, or Firm*—E. Philip Koltos

[57] ABSTRACT

A universal ripper miner used to cut, collect and transfer material from an underground mine working face includes a cutter head that is vertically movable in an arcuate cutting cycle by means of drive members, such as hydraulically actuated pistons. The cutter head may support a circular cutter bit having a circular cutting edge that may be indexed to incrementally expose a fresh cutting edge. An automatic indexing system is disclosed wherein indexing occurs by means of a worm gear and indexing lever mechanism. The invention also contemplates a bi-directional bit holder enabling cutting to occur in both the upstroke and the downstroke cutting cycle. Another feature of the invention discloses multiple bits arranged in an in-line, radially staggered pattern, or a side-by-side pattern to increase the mining capacity in each cutting cycle. An on-board resharpening system is also disclosed for resharpening the cutting edge at the end of cutting stroke position. The aforementioned improvement features may be used either singly, or in any proposed combination with each other.

10 Claims, 9 Drawing Sheets

FIG. 3
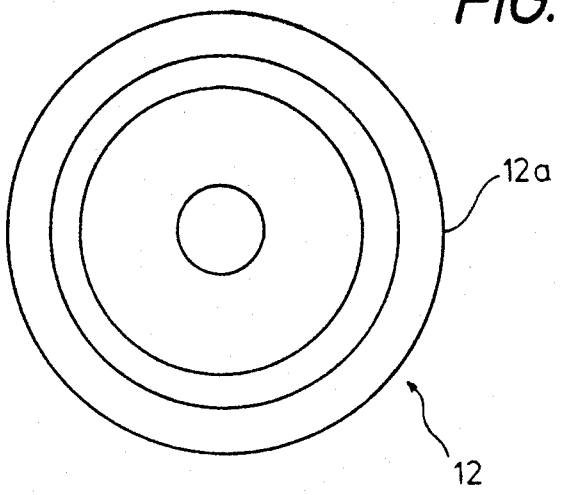
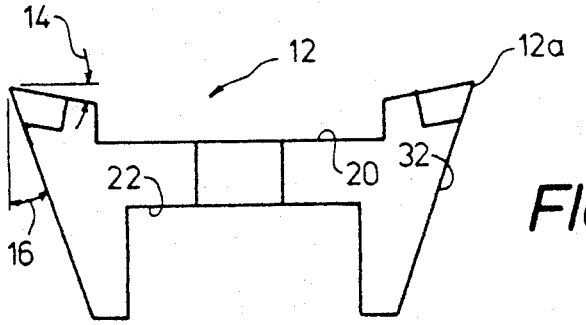
FIG. 2
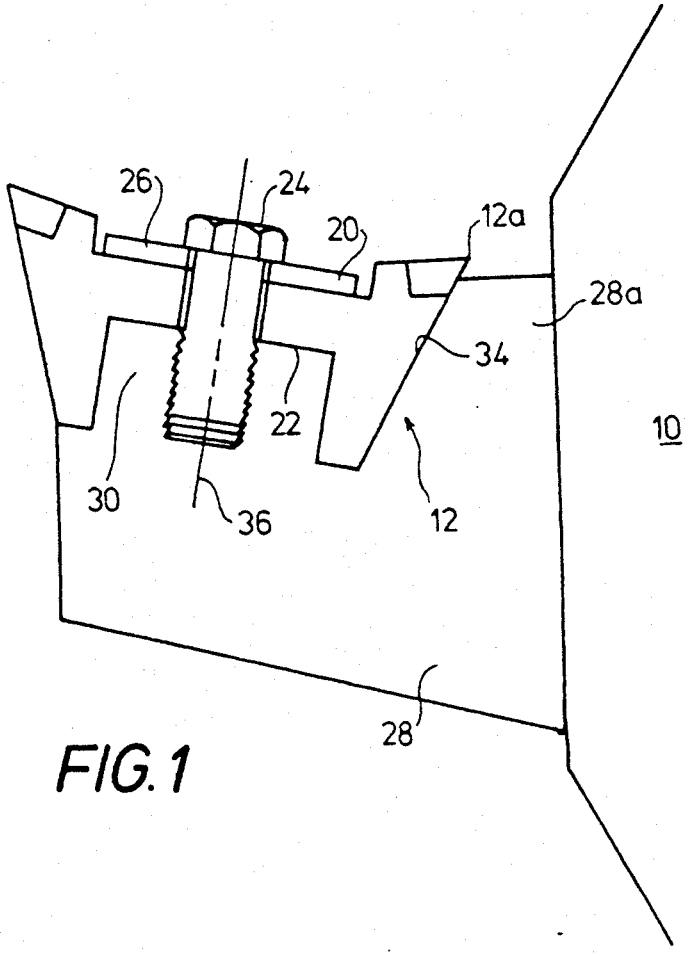
FIG. 1

FIG. 6
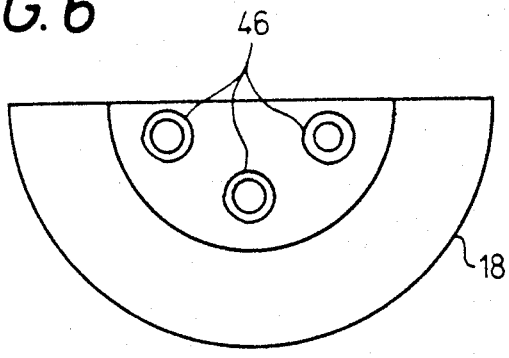
FIG. 7
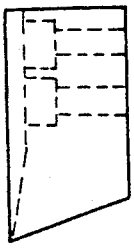
FIG. 5
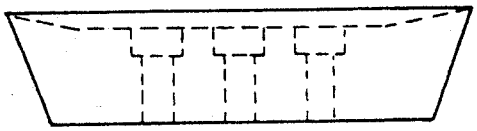
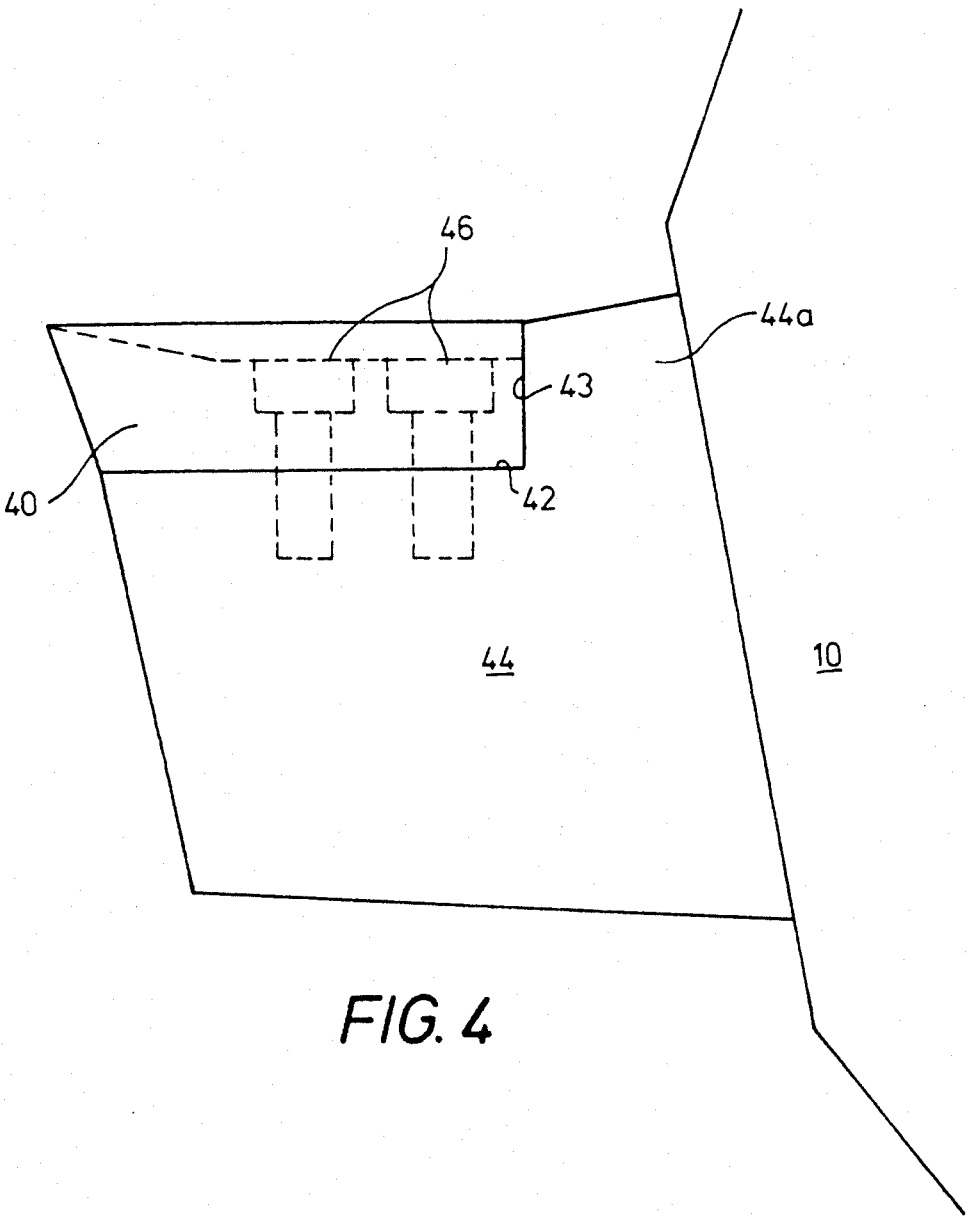
FIG. 4

FIG. 17
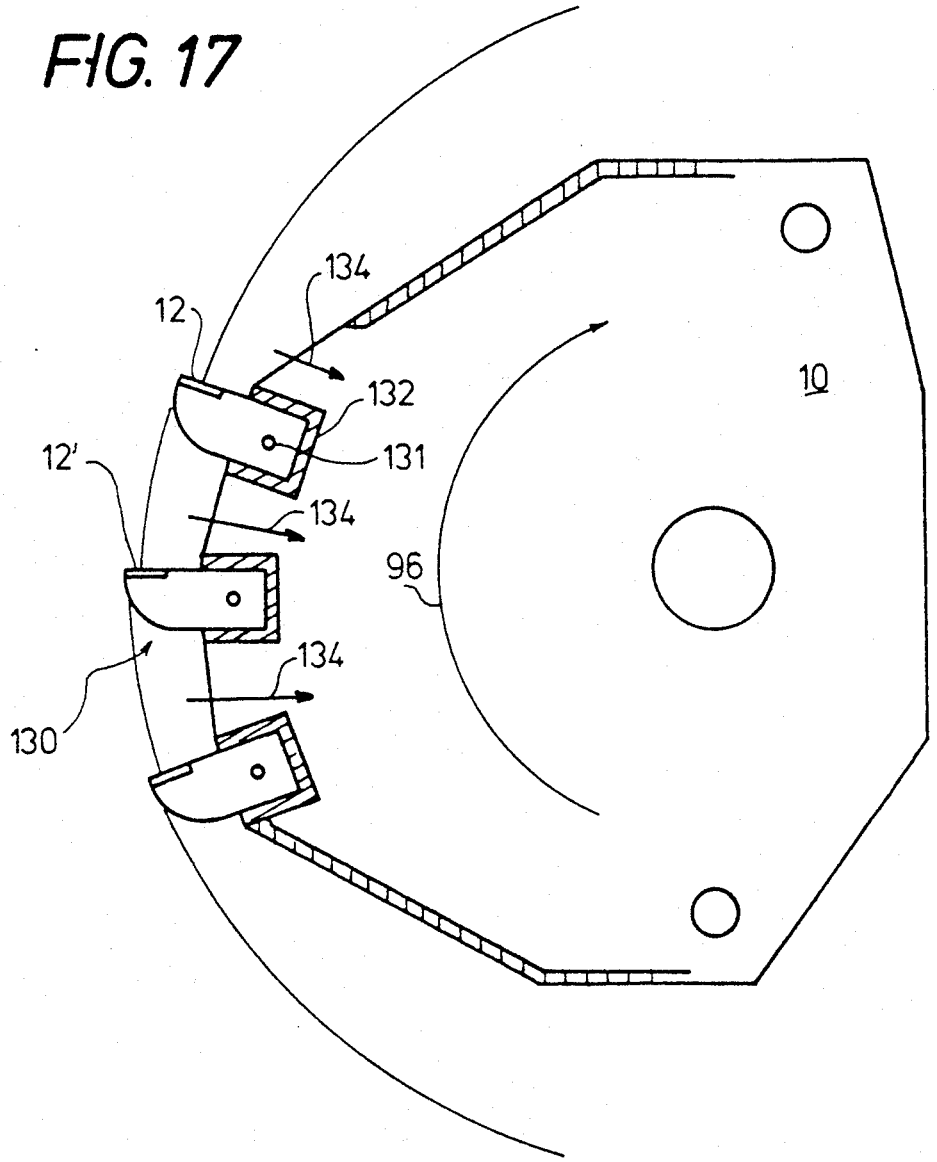
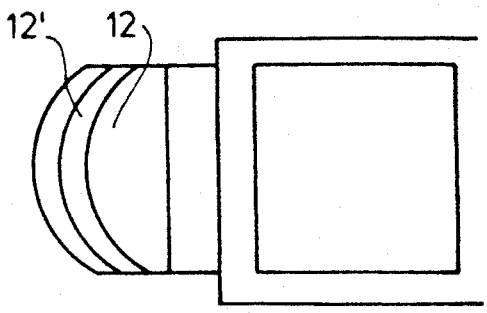
FIG. 15
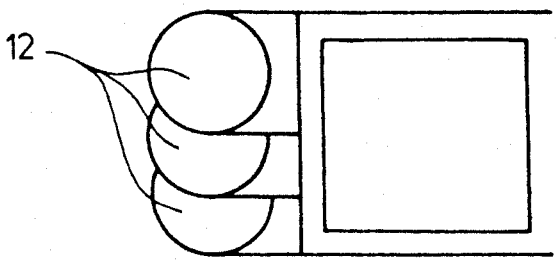
FIG. 16

FIG. 21
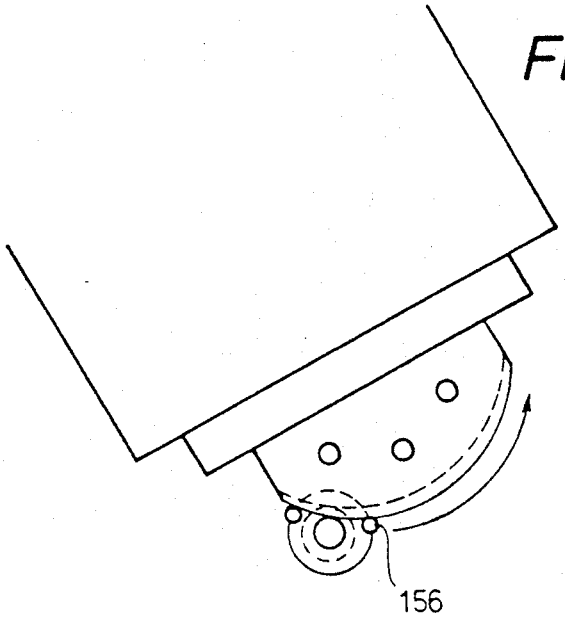
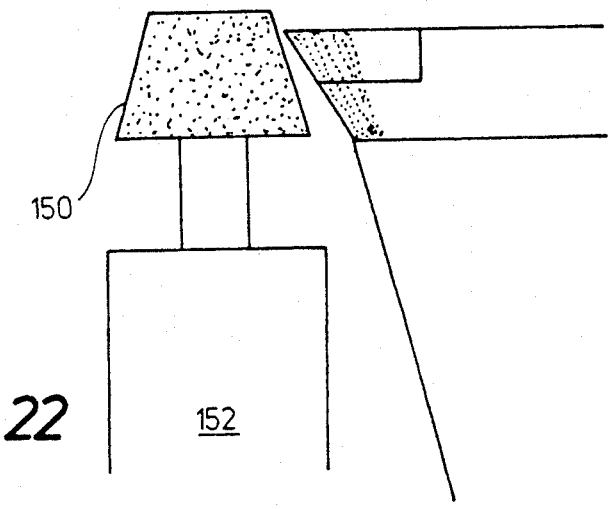
FIG. 22
FIG. 20
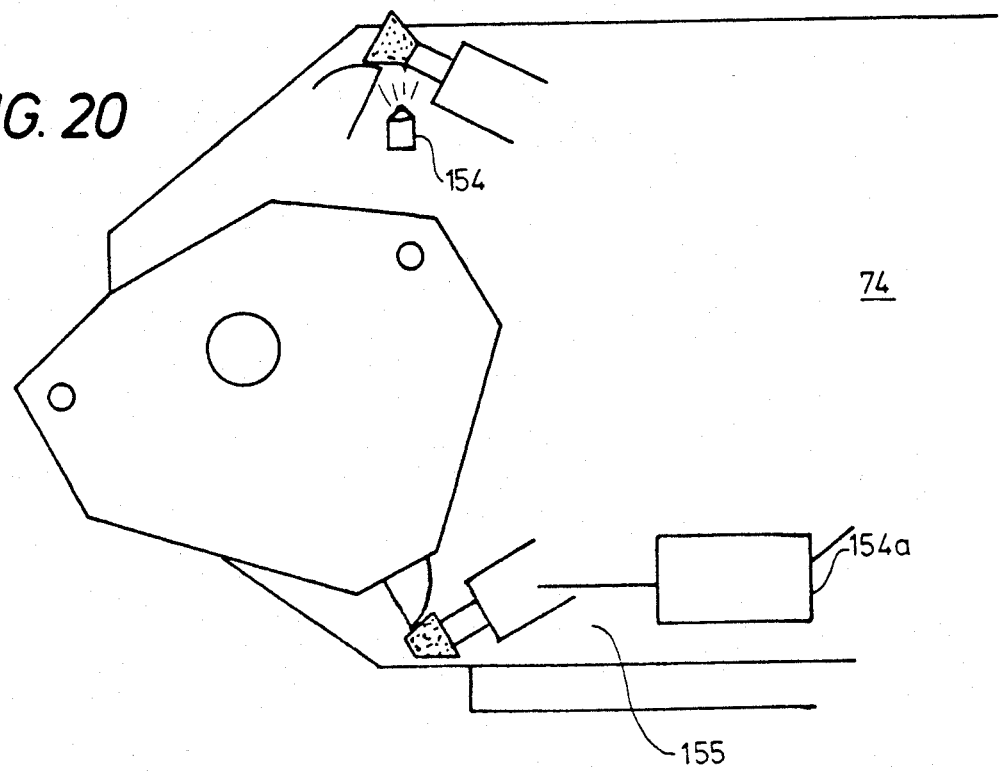

UNIVERSAL RIPPER MINER

TECHNICAL FIELD

The present invention relates generally to excavation systems which can cut, collect and transfer the cut material and, more particularly, to improvements to ripper miners relating to single and bi-directional cutter bits, multiple bits and on-board bit sharpening.

BACKGROUND ART

FIG. 1A is an illustration of our universal ripper miner disclosed in U.S. Pat. No. 4,501,448 to Roger J. Morrell and David A. Larson, assigned to the United States of America as represented by the Secretary of the Interior. Our prior ripper miner machine includes two hydraulically operated pistons 201 and 202 with their movable and extendable piston rods 203 an 204, respectively, being attached to the cutter head 206. At one end, the pistons are pivotally attached by roller shafts 220 and 221 to the machine's main frame 205 and at the other end to the movable cutter head by roller shafts 222 and 223. A center shaft 207 allows the cutter head 206 with its drag bit 208 to rotate in an arcuate path as the attached two piston rods are reciprocated by a power source within their respective movable pistons. The cutter head rotates in an arcuate vertical path through approximately 185° during its cutting swing or cycle. As the rock is cut loose from the face by drag bit 208, the cuttings are continuously collected in the hopper 209 section of the cutter head which moves in unison with the drag bit. At the end of the cutting swing, an opening 210 in the hopper allows the cuttings to drop through chute 211 into an external bin 212. From this bin, the cuttings are fed onto a conventional conveyor 213 and moved to the end of the machine and then into the mine haulage system. After each vertical cutting upswing, the bit is returned to its original starting position. The main frame 205 and cutter head are then rotated horizontally by the rotary table 214 into position for the next cutting swing. The roof jack assembly 215 pushes against the roof to lock the machine firmly in place during the cutting operation. After the bit has cut across the entire face of the heading, the main frame and cutting head are advanced forward (i.e., to the left in FIG. 1A) for the next cutting cycle by the two advance pistons 225 and 226. These pistons slide the entire machine, which is mounted to the base plate 219, along the walking beams 217 and 218. After three to four advance cycles, the machine is raised up off of the ground by jacks (not shown) the advanced pistons retracted, and the machine is ready for another series of cutting advances at a new location to the right or left of its previous cutting cycle. Thus, it is to be noted that the machine advances forward between a series of individual cutting cycles and the machine is rotated horizontally after each of its individual cutting cycles or swings.

The drag cutter 208 consists of a bit insert and a bit holder, the bit holder resisting the cutting forces and holding the bit insert in place. The bit insert does the actual rock cutting. It is held in place on the holder by bolting, or by clamping or brazing. The bit insert has only one cutting edge requiring frequent resharpening, depending upon the hardness of rock being mined, causing down time during resharpening.

It is accordingly one object of the present invention to provide a cutter bit for mining machines generally, and the ripper miner disclosed above in particular, that has multiple cutting edges.

Another object of the invention is to provide the multiple cutting edge bit with a capability of being easily and quickly indexed upon the bit holder to expose a fresh cutting edge.

Another object of the invention is to provide a bit indexing system that automatically indexes the bit to expose a fresh cutting edge without manual intervention.

As mentioned above, our prior universal ripper miner disclosed in FIG. 1A is only capable of cutting operation in the upstroke. Thereby, valuable mining time is lost each time the cutter head 206 reaches its upper end of cutting stroke through the period it is lowered by pistons 201 and 202 to its bottommost position where it is repositioned to execute the next upward cutting stroke.

Another object of the present invention is to provide a cutter head of a mining machine with a bi-directional cutter enabling the machine to mine rock in both upward and downward cutting strokes.

Another object of the invention is to provide a mining machine in general, and our ripper miner disclosed above in particular, with a bi-directional cutter that mines rock in both the upstroke and the downstroke and which has the further capability of utilizing a cutting bit with multiple cutting edges.

Still a further object of the present invention is to provide a cutter head with a multi-holder arrangement allowing a plurality of bits to be mounted upon the cutter head to improve mining efficiency.

Still a further object of the invention is to provide an on-board bit resharpening system that is capable of sharpening the cutter bit(s) at the end of an upward or downward cutting cycle.

DISCLOSURE OF THE INVENTION

A ripper miner, in accordance with the invention, comprises a cutter head having a cyclical cutting cycle traversing an arcuate angle in a generally vertical plane. The cutter head is mounted to a machine frame and means is provided for moving the cutter head with respect to the frame.

In accordance with one improvement feature of the present invention, there is provided a circular cutting bit having a circular cutting edge movable, about a central axis of rotation, to selectively expose a fresh cutting edge for improved cutting efficiency. In one embodiment, the circular cutter is formed with a bottom cylindrical recess receiving a cylindrical mounting hub formed in an upper surface of the bit holder. Thusly received, a hold down bolt secures the circular cutter to the bit holder. Loosening of the bolt permits rotation of the circular bit to expose the fresh edge.

In another embodiment, the circular cutter may be provided with an automatic indexing system for partially rotating the circular bit to expose a fresh cutting edge. In this embodiment, the circular bit is secured to an indexing shaft with a hold down bolt engaging the upper end of the shaft projecting upwardly from the mounting hub. A lower end of the indexing shaft is journalled within the bit holder and includes a worm gear in meshing contact with a worm extending transversely within a cavity formed within the bit holder. One end of the worm extends through a side wall of the bit holder and is connected to an indexing lever, via a ratchet and spring return mechanism. The indexing lever extends along a side wall of the cutter head to engage a stationary member on the machine frame as the cutter head approaches an end of cutting stroke position. Such engagement causes the indexing lever to rotate the worm screw through a predetermined angular interval, causing corresponding rotation of the circular cutting edge through the worm gear and indexing shaft.

A partial circular cutter bit is also disclosed wherein the bit is formed with a semicircular cutting edge. The bit body is secured to the bit holder with plural hold down bolts.

In accordance with another improvement feature of the present invention, the cutting head may be provided with a bi-directional bit holder pivotally secured to side walls of the cutter head and equipped with upper and lower bits engageable with a mining surface in the upstroke and downstroke, respectively, of the cutter head. In addition to the conventional opening in the cutter head located upwardly adjacent the bit holder to receiving cuttings in the upstroke, there is provided a second opening located downwardly adjacent the bit holder to receive cuttings in the downstroke. A deflector scraper may be pivotally mounted to the cutter head side walls to extend beneath the downstroke opening, ensuring that cuttings generated in the downstroke are directed into the cutter head.

In accordance with another improvement feature of the present invention, multiple bit holders may be mounted upon the cutter head to provide a plurality of bits that may be arranged in various configurations. In one such configuration, a plurality of bits are arranged in an in-line vertically spaced pattern with their bit cutting edges being located in progressively radially outward locations so that the next in-line bit cuts progressively deeper into the rock face during the upstroke or downstroke. The bits may also be arranged in a side-by-side pattern to increase the effective width of the cut.

In an alternate embodiment, a single bit holder may be used to mount a plurality of bits in individual bit holders in a desired pattern to suit rock conditions. The single, multi-bit holder may include a pair of support side walls to which the individual bit holders are mounted.

In accordance with yet another feature of the present invention, there is disclosed a bit resharpening system that comprises a motor driven grinding wheel mounted to the machine frame and equipped with a feed mechanism adapted to advance the grinding wheel into grinding contact with the bit cutting edge as the bit holder reaches an end of cutting stroke position.

The improvement features discussed above may be used separately, together, or in any combination with each other.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

BRIEF DESCRIPTION OF DRAWINGS

FIG. 1 is a side elevational view of a full circular cutter bit in accordance with a first improvement feature of our present invention;

FIG. 2 is a side elevational view of the circular cutter bit of FIG. 1 removed from the bit holder;

FIG. 3 is a top plan view of the circular bit of FIGS. 1 and 2;

FIG. 4 is a side elevational view of a partial circular cutter bit according to our invention;

FIG. 5 is a front elevational view of the partial circular cutter bit of FIG. 4;

FIG. 6 is a top plan view of the partial circular bit;

FIG. 7 is a side plan view of the partial circular bit;

FIG. 15 is a partial schematic top plan view of a multi-holder multi-bit equipped cutter head in accordance with yet another improvement feature of our invention wherein a plurality of bits are mounted in a radially staggered, vertically in-line pattern;

FIG. 16 is a partial schematic top plan view of a plurality of bits mounted in a side-by-side bit pattern;

FIG. 17 is a side elevational view of the in-line mounted bits of FIG. 15;

FIG. 20 is a partial schematic, side elevational view of a bit resharpening system in accordance with yet another feature of our invention;

FIG. 21 is a partial top plan view depicting the resharpening process at one of the resharpening locations of FIG. 20;

FIG. 22 is a side elevational view of the resharpening process occurring in FIG. 21.

BEST MODE FOR CARRYING OUT THE INVENTION

The present invention is directed towards multiple improvements made to the universal ripper miner disclosed in our prior U.S. Pat. No. 4,501,448 issued to Roger J. Morrell and David A. Larson on Feb. 26, 1985, the disclosure of which is hereby expressly incorporated by reference herein. The improvements according to the present invention discussed infra, relate to improved cutting bits mounted to a cutter head 10 of the type disclosed in our aforesaid '448 patent. The five improvements comprise the structure and use of a circular cutter, bit indexing, bi-directional cutters, multiple cutters and on-board bit resharpening. The five improvements can be used singly, altogether, or in any desired combination thereof. The use of these improvements does not change the basic operation of the universal ripper miner disclosed in the '448 patent and, if desired, these improvements may be incorporated into other types of excavating machines as will occur to one of ordinary skill in the art based upon a review of the present disclosure.

CIRCULAR CUTTER

Figure 1A:
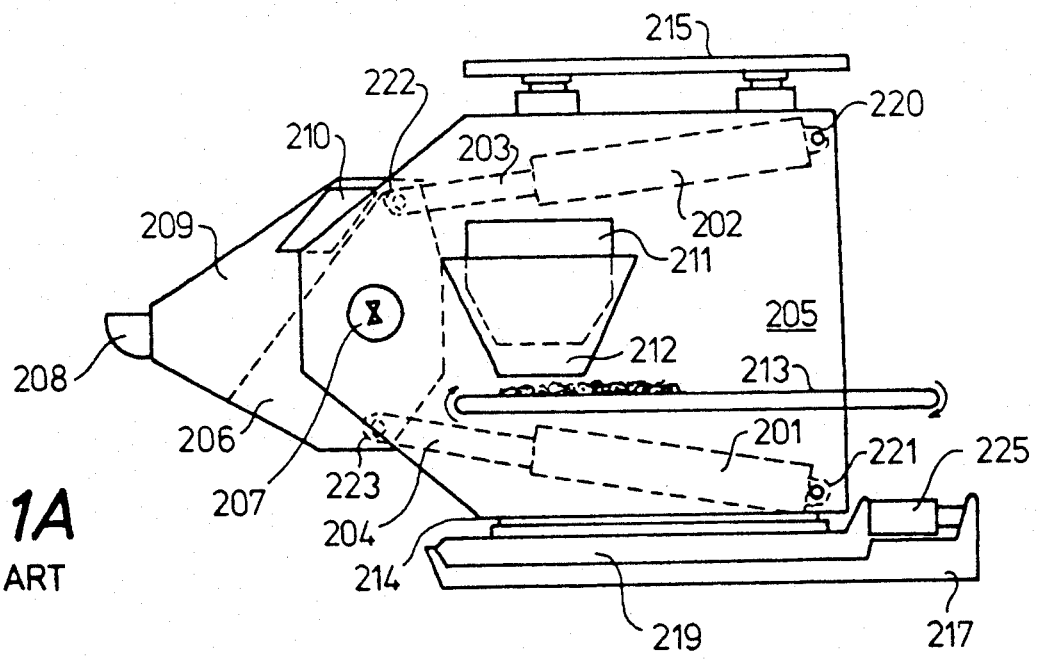
FIG. 1A PRIOR ART
FIG. 1A is an illustration of a side elevational view of our universal ripper miner disclosed in our prior United States '448 patent.

The ripper miner (not shown) of the type disclosed in our '448 patent and the cutter head 10 thereof may be provided with a circular cutter 12 of the type depicted in FIGS. 1-3. Circular cutter 12 includes a bit 12' formed with a circular shaped cutting edge 12*a* (in the top plan view of FIG. 3) formed with appropriate rake and clearance angles 14 and 16 and of a material that has the ability to cut rock anywhere along its circular edge. More specifically, the circular bit 12' can have a positive, zero or negative rake angle 14 and can have a full 360° circular edge or a partial circular edge 18 as depicted in FIGS. 4, 5, 6 and 7. The improved cutting efficiency of these circular edges (i.e., full or partial) will be realized in both cases. Circular cutter bits 12 can be constructed of heat treated tool steel and can have a cutting edge composed of a tungsten carbide or other hard material. The cutters 12 can be made in a variety of sizes, with different attack, rake and clearance angles to suit any cutting condition.

More specifically, the circular cutter bit 12' is formed with cylindrical top and bottom recesses 20 and 22 in upper and lower surfaces thereof, respectively. The top cylindrical central recess receives a hold down bolt 24 and washer 26 for securing the circular cutter 12 to the bit holder 28 by interfitting the bottom recess 22 with a cylindrical mounting hub 30 projecting upward from the bit holder 28. An outer annular surface 32 of the circular cutter 12 is of frustoconical shape that is supported on the cutter bit holder 28 by mounting hub 30. The surfaces 32,34 advantageously permit rotation of the circular bit 12 on the mounting hub 30 upon loosening of the hold down bolt 24 to expose a fresh cutting edge.

Circular cutter 12 provides several important advantages. One advantage is the improved cutting efficiency which tests have shown to be up to twice as energy efficient as conventional cutters. Another important advantage is the continuous cutting edge 12*a* that the circular bit 12' provides, allowing the bit to be incrementally rotated through 360° to incrementally expose fresh cutting edges before resharpening is required. This rotation can be done manually by loosening the hold down bolt 24 as described above or by a cutter bit indexing system of the type described below.

As mentioned above, the hub 30 may be integrally formed in an upper surface of the bit holder 28, or welded or otherwise secured thereto. The hub 30 serves both to secure the bit 12 and to provide rotation or indexing motion about its central longitudinal axis 36.

FIGS. 4-7 are illustrations of a partial circular bit 40 having a partial circular cutting edge 18 (in top plan view of FIG. 6) flushly mounted within an upper recess 42 of the bit holder 44 by means of plural hold down bolts 46. The attack angle of both the full and partial circular bits are respectively defined by the mounting hub 30 (FIG. 1) or bottom seating surface 42 (FIG. 4) of the bit holders 28,44.

BIT INDEXING

The ripper miner such as disclosed in our '448 patent can be provided with bit indexing which is the ability to rotate the bit 12 in order to keep a sharp cutting edge in contact with the rock. As the bit 12 cuts rock, its edge 12*a* gradually dulls which adversely affects energy efficiency, bit forces and dust generation. The greatest bit wear occurs primarily at the point of the cutting edge 12*a* in deepest contact with the rock. The remainder of the cutting edge is relatively unworn. On a bit with several cutting edges or continuous cutting edges, it would be desirable to rotate the bit a small amount to present a sharp cutting edge to the rock. After all cutting edges are worn, the bit can be resharpened.

The full circular bit 12 of FIGS. 1-3 may have its continuous cutting edge 12*a* progressively exposed by indexing the bit around the mounting hub central longitudinal axis 36 either manually or automatically. For manual indexing, the central hold down bolt 24 is loosened and the bit 12 is rotated about the mounting hub 30 while in full seating engagement therewith to expose a fresh sharp cutting edge. The hold down bolt 24 is then re-tightened. This type of manual indexing occurs where the need for resharpening is infrequent.

Figure 10:
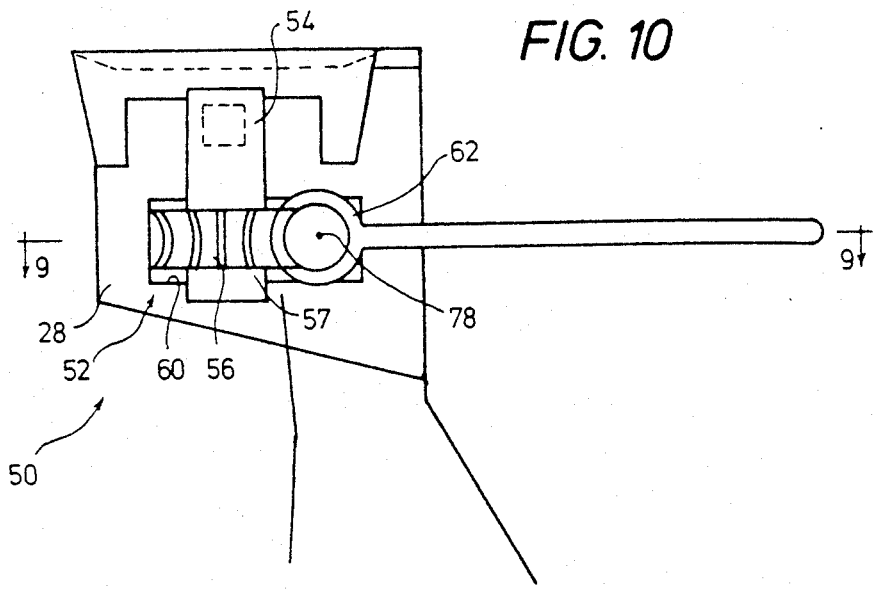
FIG. 10 is a partial cross-section view taken along the line 10—10 of FIG. 9.
Figure 9:
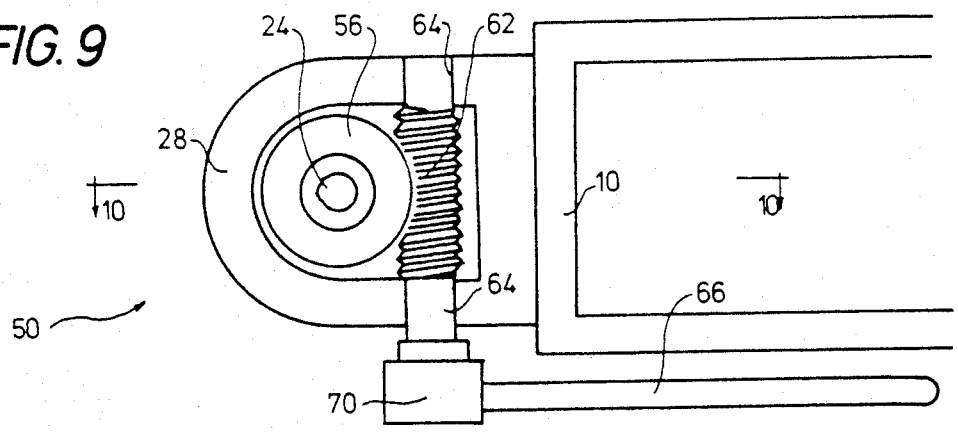
FIG. 9 is a partial cross-sectional view taken along the line 9—9 of FIG. 10.
Figure 8:
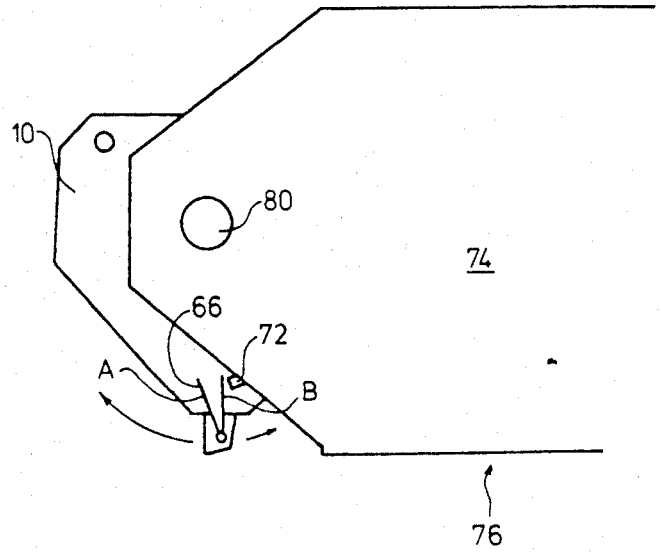
FIG. 8 is a schematic elevational view of an automatic indexing system in accordance with another improvement of our present invention.

FIGS. 8-10 are illustrations of an automatic bit indexing system 50 that is preferred for use when the requirement for bit indexing is frequent. With reference to FIG. 10, the automatic bit indexing system 50 comprises a gear drive 52 including an indexing shaft 54 extending through the mounting hub 30 to which shaft the circular bit 12 is secured with the hold down bolt 24. A worm gear 56 is mounted to a lower end portion 57 of the indexing shaft 54 within an interior housing cavity 6 located within the bit holder 28. The worm gear 5 meshes with a worm screw 62 journalled in side housing portions 64 of the bit holder 28 (FIG. 9) and is rotated by an indexing lever 66 secured to one end of the worm screw projecting outwardly from the bit holder 28 via a rachet and spring return mechanism 70. The indexing lever 66 projects away from the bit 12 along the cutter head 10.

The automatic bit indexing system 50 is adapted to operate automatically as the bit 12 reaches the end of a cut and is out of contact with the rock surface. For example, as depicted in FIG. 8, the indexing lever 6 may be activated by contact with a stationary member 72 on the machine frame 74 of the ripper 76 with such contact causing the lever to rotate about the longitudinal axis 78 of the worm screw 62 through a predetermined angular interval with co-rotation of the worm screw causing corresponding rotation of both the worm gear 56 and indexing shaft 54 and thereby the bit itself. The indexing lever 66 resets automatically from position A to position B as the cutter head 10 begins its cut by rotating about the center shaft 80 of the ripper, i.e. as the indexing lever moves out of contact with the stationary member 72.

It is within the scope of this invention to reset the indexing or ratchet lever 66 with, for example, weights. Also, the gear drive 52 can be powered independently by a separate motor providing rotative torque to the worm screw 62 with automatic operation through a series of limit switches, or manual operation by an operator actuating the motor.

The manual and automatic bit indexing systems advantageously save valuable production time by reducing the time required to change worn bits. The indexing systems also ensure that a sharp bit is available for cutting. While the design of the indexable bit is subject to modification (i.e., it need not necessarily be a circular bit) the bit nonetheless must have multiple cutting edges. These bits must be resharpened when all of their cutting edges are worn, using either conventional sharpening methods or the automatic sharpening system discussed infra.

BI-DIRECTIONAL CUTTER

Figure 11:
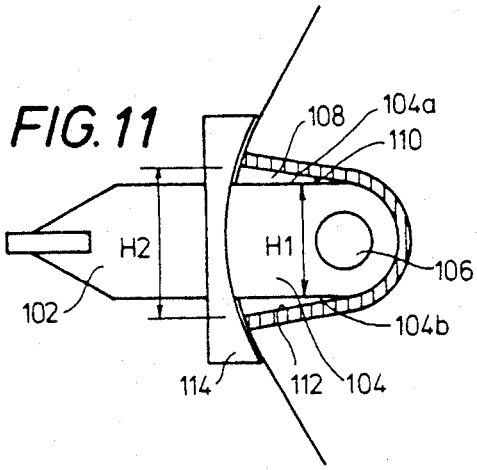
FIG. 11 is a partial schematic elevational view of a single bit type of bi-directional cutter in accordance with another improvement feature of our invention.
Figure 12:
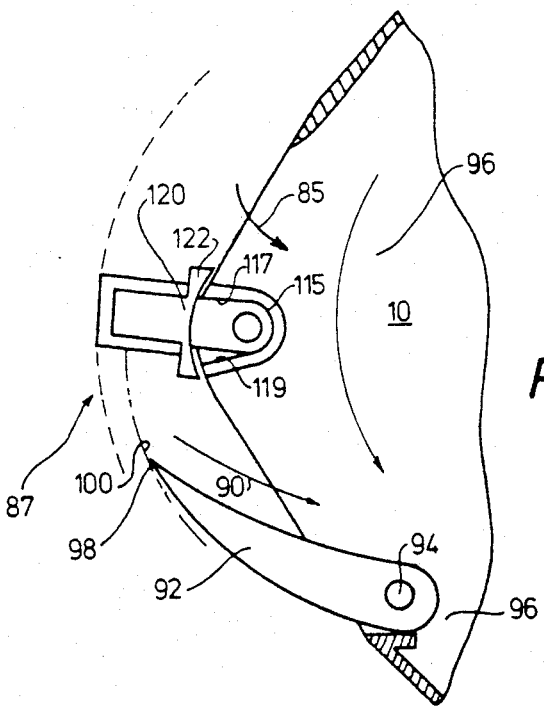
FIG. 12 is an elevational view of a double bit type of bi-directional cutter in accordance with our invention.

FIGS. 11–14 are illustrations of bi-directional cutters that can be mounted to the ripper miner to provide a capability of cutting both on the upstroke (as in the '448 patent) and the downstroke to effectively double the production rate of the ripper miner by eliminating the non-productive time associated with the non-cutting downstroke. As depicted in FIG. 12, an opening 85 is provided in the cutter head 10 above the bit arrangement 87 to receive cuttings generated during the upstroke and such an opening is disclosed in the universal ripper miner of the '448 patent. Preferably, a second opening 90 is provided in the cutter head below the bit arrangement 87 to receive cuttings generated during the downstroke. To direct the cuttings into the head 10, a deflector-scraper 92 may be pivotally mounted at a lower end of the opening 90 with a pivot shaft 94 extending between housing side walls 96 of the cutter head. The deflector-scraper 92 is arranged so that its scraping edge 98 rests against the rock surface 100 being mined in the downstroke to direct cuttings into the opening 90. Preferably, the deflector-scraper blade 92 is arranged so that its scraper edge 98 traverses an arcuate path that is located radially inwardly of the arcuate path circumscribed by the bits. In this manner, contact between scraper edge 98 and the wall being cut by the bit arrangement 87 in the upstroke is avoided.

Figure 13:
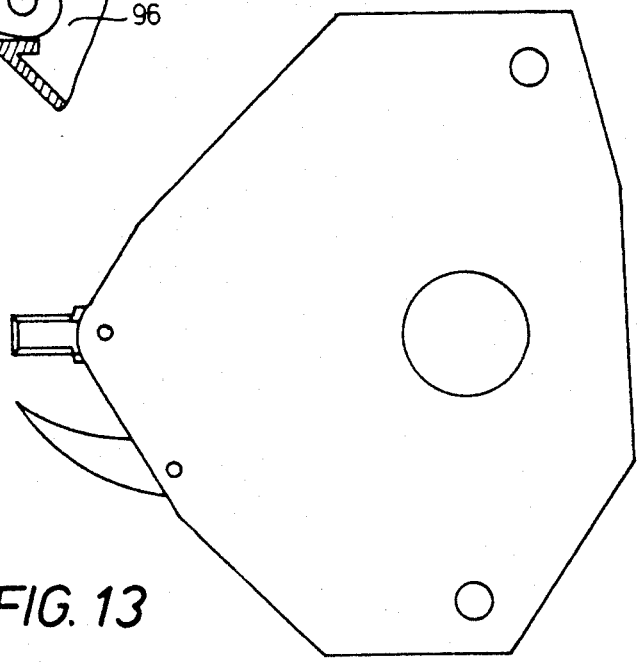
FIG. 13 is a schematic elevational view depicting the relative location of the bi-directional cutter in relation to the cutter head.

The bi-directional cutter 87 may be either pivoted or non-pivoted with single or double bit inserts. The pivoted type with a single bit arrangement is depicted in FIG. 11 and the pivoted type with a double bit arrangement is depicted in FIGS. 12 and 13. In both arrangements, the bit holder 102 has an inwardly extending portion 104 between and pivotally secured to the cutter head housing side walls 96 by means of a retainer pin 106. The holder 102 projects outwardly from the side walls 96 through an opening 108 that limits pivotal movement in the upstroke and downstroke about the pivot pin 106.

More specifically, with reference to the single bit embodiment of FIG. 11, the inwardly extending portion of holder bar 10 of a height H1 that is less than the corresponding height H2 of the opening 108 formed by edges of the side walls through which the holder extends. The upper and lower edges 110 and 112 define stop surfaces against which corresponding upper and lower surfaces **104*a* and 104*b* of portion 104 of the holder bar 102 abut in the upstroke and downstroke respectively. The width of the opening in the cutter head 10 only slightly exceeds the corresponding width of portion 104 of the holder bar 102 to provide guiding surfaces maintaining the movement of the holder in a vertical plane about the retainer pin 106. The bit holder 102 includes a dirt shield 114**.

The single bit is schematically depicted in FIG. 11 and may obviously take various forms, such as the full circular bit configuration of FIGS. 1–3, or the partial circular bit of FIGS. 4–7.

Figure 14:
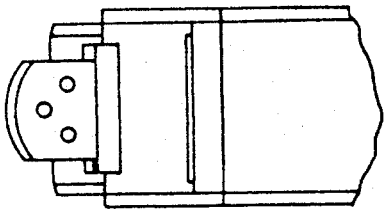
FIG. 14 is a top plan view of the bi-directional cutter of FIG. 12.

In the FIG. 12 embodiment of the double bit bi-directional cutter, a U-shaped receiver 115 welded to the cutter head housing side walls 96 has upper and lower interior contact surfaces 117 and 119 limiting the range of movement of the bit holder 120 in the upstroke and downstroke positions. The holder 120 includes a collar portion 122 substantially corresponding to the upwardly projecting portion **28*a*,44*a* of bit holders 28,44 against which portion either the partial or full circular bits can abut as per FIGS. 1 or 4. Although a pair of upper and lower partial circular cutter bits are depicted in FIGS. 12–14, it will be understood that the full circular cutter bits of FIGS. 1–3 may be utilized in either the FIG. 11 or 12** embodiment of the invention.

The bit inserts used in the above-identified bi-directional cutters can be made in a variety of shapes and sizes and with any desired rake or clearance angle. These bits can be attached to the bit holder by the usual bolts or clamps and, in the case of the double bit arrangement, either bit can be replaced independent of the other. The bi-directional cutters of FIGS. 11–14 may be used in conjunction with any other (or all) of the other improvements identified herein.

MULTIPLE CUTTERS

The ripper miner may be equipped with more than one cutter bit to either improve productivity or maintain productivity in very hard rock. The number, shape and mounting pattern of these cutter bits can vary to suit conditions, as will occur to one of ordinary skill in the art upon review of the following. However, the cutters are preferably mounted in such a way as to produce a full depth of cut in a single pass. Thereby, the operation of the ripper miner is the same irrespective of whether a single cutter or multiple cutters are used.

If sufficient power is available to the cutter head, then multiple cutters can be used to increase the productivity of the ripper miner. This situation will normally occur in softer, non-abrasive type rocks. In hard rock, it may not be possible to operate a cutter at full depth due to the presence of high cutter forces that could cause breakage or unacceptable high wear of the cutter bits. In this case, several cutters, each taking a portion of the cutter load, will facilitate maintenance of full production while keeping the cutters from being overloaded or damaged.

Multiple cutters may be installed on the ripper miner in several different ways. With reference to FIGS. 15 and 17, for example, and in accordance with one embodiment of the invention, the cutter head includes a plurality of similar bit holders 130 that may be bolted at 131 to reinforced mountings 132 in the cutter head 10 in vertically spaced, in-line relationship to each other with an opening 134 formed in the cutter head side walls 96 above each bit to receive the cuttings. Preferably, the bits 12 are arranged in line with bit cutting edges **12*a* being located in progressively radially outward locations so that the next in-line bit (e.g., 12') cuts progressively deeper into the rock. These radially displayed locations are apparent from FIGS. 15 and 17. The bits 12 can also be arranged in a side by side pattern as depicted in FIG. 16 to increase the effective width of the cut. In the side by side arrangement, each bit 12** preferably has the same depth of cut. The bits may also be arranged in an echelon pattern, a V-shaped pattern, etc., as will occur to one of ordinary skill based upon a review of this disclosure. The bits can also be replaced independently of one another and can be resharpened as required.

The bit holder 130 may also take the form of bit holders 28 or 44 depicted in FIGS. 1-7.

Figure 19:
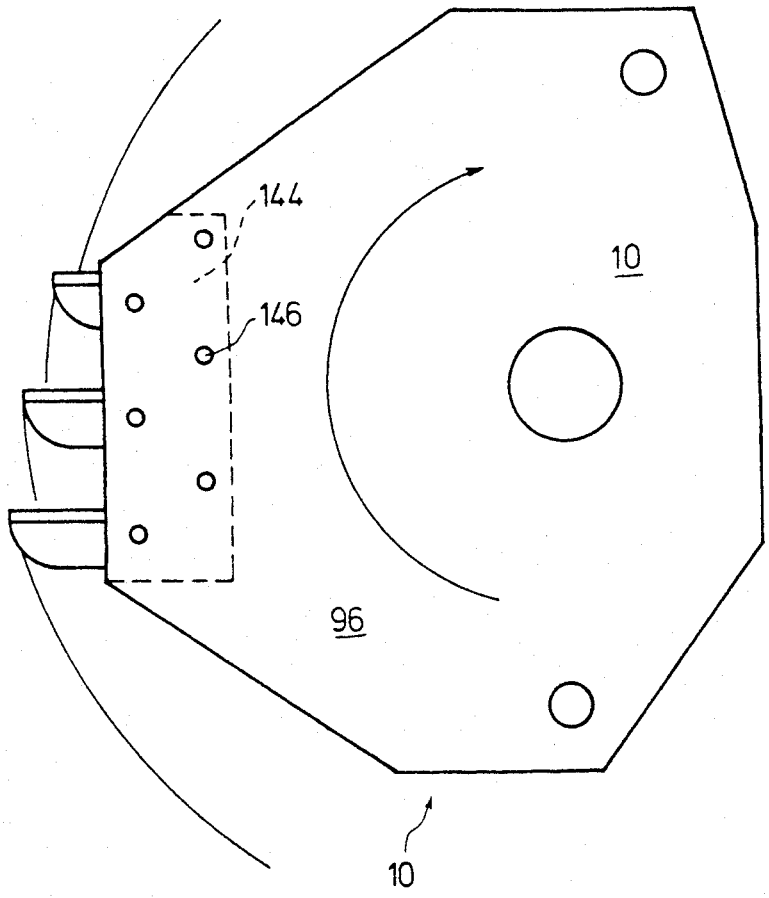
FIG. 19 is a side elevational view depicting the single multi-bit holder mounted to the cutter head side walls.
Figure 18:
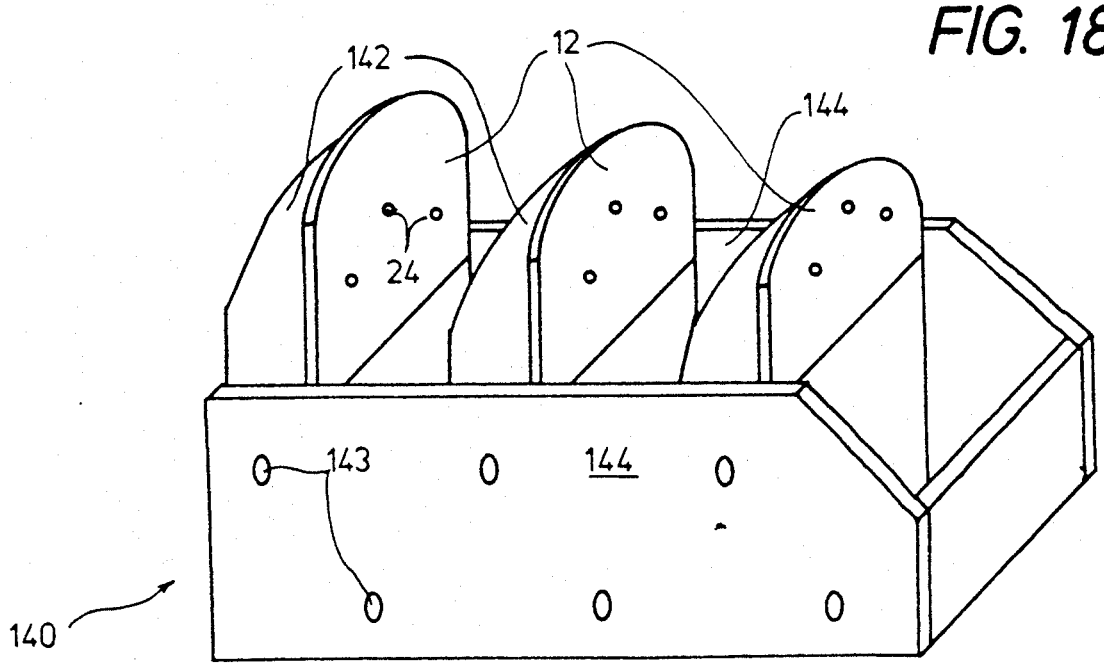
FIG. 18 is an alternate embodiment of a single multi-bit holder for mounting the plural bits in the vertically in-line pattern of FIG. 15.
Figure 24:
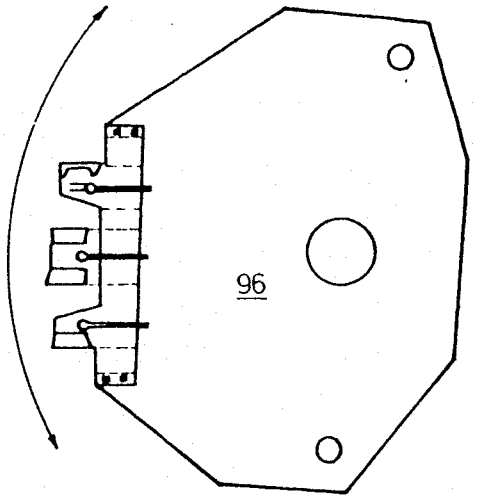
FIG. 24 is a side elevation view of the FIG. 23 embodiment as mounted to the cutter head.

In an alternative embodiment depicted in FIGS. 18 and 19, a single bit holder 140 may be used to mount a plurality of bits 12 in individual bit holders 142 (which may be bit holders 28 or 44) in a desired pattern to suit rock conditions. The single, multi-bit holder 140 of FIG. 18 contains a plurality of bits mounted in the in-line pattern of FIGS. 15 and 17. The individual holders 142 are bolted at 143 to a pair of support walls 144 which in turn are secured to side walls 96 of the cutter head 10 with bolts 146. The individual bits 12 are secured to their respective holders 142 with bolts 24 in either the manner described above or by the use of fastening means that will easily occur to one of ordinary skill.

ON-BOARD RESHARPENING OF BITS

The ripper miner has the ability to resharpen its bits without removing them from the machine. The ability to keep the bits sharp is important to the success of the cutting method. Because the ripper miner has one, or at the most a few bits, it becomes a practical matter to sharpen these bits. The benefits of a sharp cutting bit are many and important. These include less cutting forces acting on the bit, greater energy efficiency, less dust generation, and reduced time required for bit changes. The ability to resharpen in hard rock mining is even more important as bits dull rapidly and only sharp bits are able to cut hard rock effectively.

A preferred method of resharpening is shown in FIGS. 20-22 although the exact mechanism can vary somewhat. The primary features are a grinding wheel 150 which has the correct angle and shape and is the appropriate composition for grinding tool steel, tungsten carbide, or other bit materials. The grinding wheel 150 is rotated at high speed by an appropriate motor 152 and jets 154 of cooling and cleaning liquid preferably to keep the bit clean and cool during sharpening. FIGS. 21 and 22 illustrate resharpening of a single bit 12 of partial circular shape, however, the method can be used for multiple bits, full circular bits and for bits of different shapes.

The resharpening process will normally take place at the end of, or at the start of, the cutting stroke when the bit 12 is out of contact with the rock surface. At this point, the resharpening assembly which is mounted on the frame 74 of the mining machine is moved into the correct orientation to the bit and the rotating grinding wheel 150 is moved across the clearance edge 12*a* of the bit. This process removes the flat surface on the clearance side of the bit and restores the bit to its original sharpness. Normally, only a few hundredths of an inch will be removed during each resharpening cycle although this can be adjusted to suit wear conditions. The bits can be resharpened until they can no longer cut clearance for the bit holder. Depending on the bit and holder design, this can range up to several inches. The resharpening process is expected to take only a few seconds to accomplish and can be less frequently and as desired, e.g., at the end of each cutting stroke.

The resharpening assembly 155 comprises a grinding wheel 150 with its rotation motor 152, a feed mechanism schematically shown at 154*a* which sets the amount to be removed during each pass, and a mechanism containing guides 156 (which may be mounted to the motor) to move the wheel across the bit 12 in the desired path. Details of this assembly, the number of such assemblies and their locations may vary to suit the number and type of bits used and the configuration of the ripper miner.

COMPOSITE CUTTING SYSTEM

Figure 23:
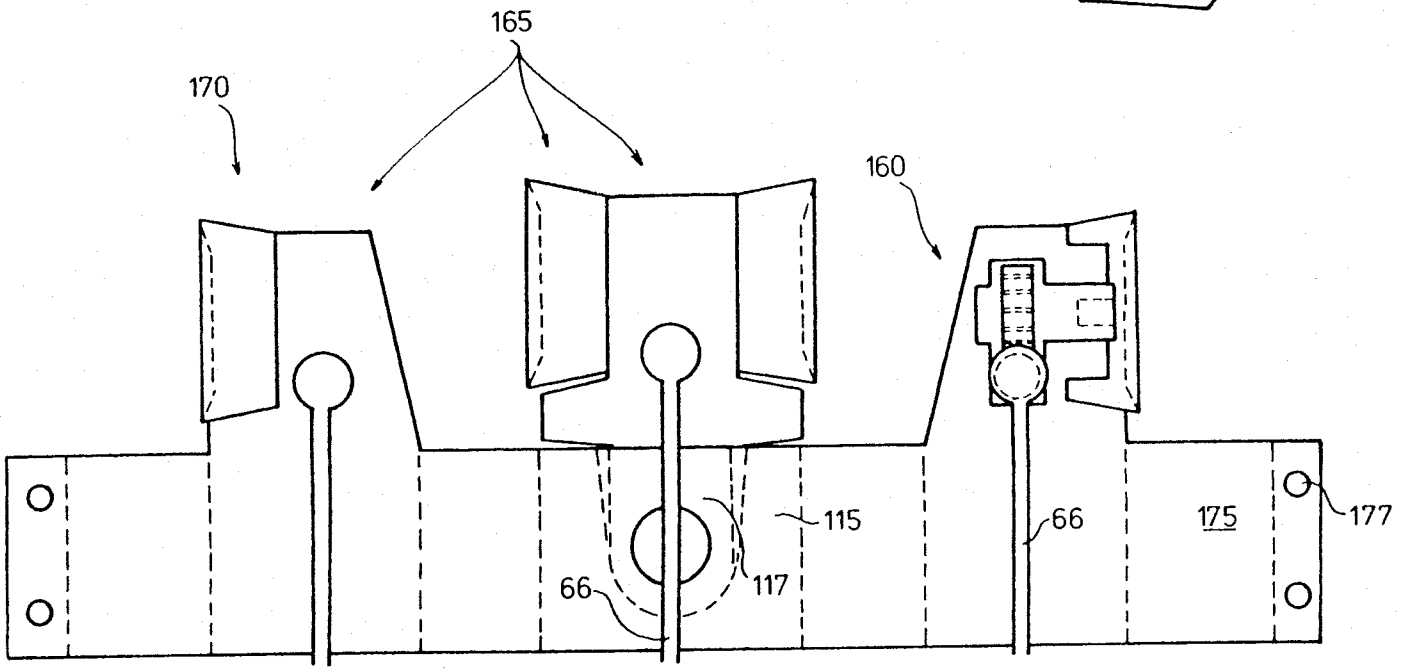
FIG. 23 is a side elevational view depicting one possible combination of a number of the improvements according to the present invention used in conjunction with a single cutter head.

The improvement features discussed supra may be used separately, together, or in any combination with each other. FIG. 23 is an illustration of four improvements used together in a single cutting system. For example, there are provided three individual bit holders 160, 165 and 170 with bit holders 160 and 170 being substantially identical to each other with a full circular bit 12 and the automatic indexing system 50 depicted in FIGS. 8-10. The lower circular bit on bit holder 170 is mounted to cut material in the downstroke while the upper full circular bit in holder 160 cuts only in the upstroke. The bit holders 160 and 170 are stationarily mounted to a frame arrangement 175 that may be bolted at 177 between side walls 96 of the cutter head 10.

The intermediate holder 165 incorporates top and bottom full circular bits in the bi-directional cutting arrangement analogous to the FIG. 12 embodiment. The intermediate holder 165 also includes an automatic indexing system 50 of the type disclosed in FIGS. 8-10.

The composite cutting system of FIG. 23 is an illustration of but one way to combine the individual improvement features but are not intended to limit the scope of the present invention. The combinations disclosed above and obvious variations thereof may be used to achieve the desired performance in virtually any cutting conditions.

From the foregoing descriptions of the preferred embodiments of our improvements to the universal ripper miner such as disclosed in our '448 patent, it should be clear that its operation contemplates several types of improvements designed to be used with our universal ripper miner without requiring any change in its basic operating principles. It will also occur to one of ordinary skill in the art that the individual improvements disclosed herein, either individually or in any desired combination, may be incorporated into other types of mining machines.

We claim:

1. A ripper miner comprising:

a movable cutter head having a cyclical cutting cycle traversing an arcuate angle in a generally vertical plane;

a material drag cutter having a bit holder and at least one removable material engaging bit insert therein, said drag cutter being mounted on said cutter head and extending therefrom, said drag cutter being movable with the head to engage the material to be cut with its removable bit during the cutting cycle;

machine frame means for mounting the cutter head to the miner;

first means for moving the cutter head and drag cutter with respect to said frame means from its initial position in the aforesaid cyclical arcuate motion and then returning the bit to its original position to provide for removable bit entrance and exit into the material;

material collection and transfer means mounted on the cutter head and frame means for temporarily collecting and storing collected cuttings before they reach the mine floor;

wherein said at least one bit insert is a substantially circular bit having a substantially circular cutting edge, and means for mounting the bit to the bit holder, wherein said mounting means is operable to enable rotation of the bit to expose a fresh cutting edge to the material being cut by advancement of the fresh cutting edge into the generally vertical plane without removal of the bit from the mounting means.

2. A ripper miner comprising:

a movable cutter head having a cyclical cutting cycle traversing an arcuate angle in a generally vertical plane;

a material drag cutter having a bit holder and at least one removable material engaging bit insert therein, said drag cutter being mounted on said cutter head and extending therefrom, said drag cutter being movable with the head to engage the material to be cut with its removable bit during the cutting cycle;

machine frame means for mounting the cutter head to the miner;

first means for moving the cutter head and drag cutter with respect to said frame means from its initial position in the aforesaid cyclical arcuate motion and then returning the bit to its original position to provide for removable bit entrance and exit into the material;

material collection and transfer means mounted on the cutter head and frame means for temporarily collecting and storing collected cuttings before they reach the mine floor;

wherein said at least one bit insert includes plural cutting edges, and means for mounting the bit insert to the bit holder, wherein said mounting means is operable to enable rotation of the bit to expose a fresh cutting edge to the material being cut by advancement of the fresh cutting edge into the generally vertical plane, wherein said mounting means is a cylindrical mounting hub formed in an upper surface of the bit holder and a bottom cylindrical recess in the bit insert which is thereby seated on the hub and rotatable thereabout.

3. The ripper miner of claim 2, further including a hold down bolt securing to the bit insert to the hub, loosening of the bolt enabling said rotation of the bit insert.

4. The ripper miner of claim 2, wherein said mounting means further includes an indexing shaft rotatably mounted in the bit insert with an upper end of the shaft projecting upward from the hub, a hold down bolt fastening the bit to the upper end of the shaft for rotation therewith, a worm gear fixed to the shaft, a worm screw meshing with the worm gear and an indexing lever secured to one end of the worm screw, said lever being engageable with the machine frame means at an end of cutting stroke position to incrementally rotate the cutting edge via incremental rotation of the worm screw, worm gear and thereby the indexing shaft.

5. The ripper miner of claim 4 further including a ratchet and spring return mechanism connecting the lever to the worm screw for transmitting incremental rotation from the lever to the worm screw as the cutter head reaches its end of stroke position and for enabling spring induced return movement of the lever into its original stationary position as the cutter head advances the lever out of contact with the machine frame means.

6. The ripper miner of claim 4, wherein said worm screw and worm gear are mounted within the bit holder.

7. The ripper miner of claim 2, wherein said at least one bit insert is a substantially circular bit having a substantially circular cutting edge.

8. A ripper miner comprising:

a movable cutter head having a cyclical cutting cycle traversing an arcuate angle in a generally vertical plane;

a material drag cutter having a bit holder and at least one removable material engaging bit insert therein, said drag cutter being mounted on said cutter head and extending therefrom, said drag cutter being movable with the head to engage the material to be cut with its removable bit during the cutting cycle;

machine frame means for mounting the cutter head to the miner;

first means for moving the cutter head and drag cutter with respect to said frame means from its initial position in the aforesaid cyclical arcuate motion and then returning the bit to its original position to provide for removable bit entrance and exit into the material;

material collection and transfer means mounted on the cutter head and frame means for temporarily collecting and storing collected cuttings before they reach the mine floor;

wherein said at least one bit insert is formed with bi-directional upper and lower cutting edges for respectively engaging to cut the mining surface in the upstroke and the downstroke of the cutter head, wherein said bit holder is pivotally mounted to the cutter head and automatically pivotable into upper and lower positions to position the upper and lower cutting edges, respectively, for cutting contact in the downstroke and the upstroke of the cutter head, wherein said cutter head further includes upper and lower openings located respectively above and below and adjacent the upper and lower cutting edges to respectively receive cuttings generated during the upstroke and downstroke.

9. The ripper miner of claim 8, further including a deflector scraper projecting toward the mining face from a lower portion of the lower opening to direct cuttings generated during the cutting downstroke into the lower opening.

10. A ripper miner comprising:

a movable cutter head having a cyclical cutting cycle traversing an arcuate angle in a generally vertical plane;

a material drag cutter having a bit holder and at least one removable material engaging bit insert therein, said drag cutter being mounted on said cutter head and extending therefrom, said drag cutter being movable with the head to engage the material to be cut with its removable bit during the cutting cycle;

machine frame means for mounting the cutter head to the miner;

first means for moving the cutter head and drag cutter with respect to said frame means from its initial position in the aforesaid cyclical arcuate motion and then returning the bit to its original position to provide for removable bit entrance and exit into the material;

material collection and transfer means mounted on the cutter head and frame means for temporarily collecting and storing collected cuttings before they reach the mine floor, further including a plurality of separate bit inserts mounted to the cutter holder to engage the mining face in the same cutting stroke, wherein said separate bit inserts are mounted to the cutter head in vertically spaced in-line arrangement with each other with their cutting edges respectively in progressively radially outward locations so that the next in-line cuts progressively deeper into the mining face.

* * * * *